US006354456B2

(12) United States Patent
Rapson

(10) Patent No.: US 6,354,456 B2
(45) Date of Patent: Mar. 12, 2002

(54) SEALABLE MULTICOMPARTMENT CONTAINER

(75) Inventor: Dalmian F Rapson, Swindon (GB)

(73) Assignees: Dalmian Rapson; Patrick John William Cole, both of Wilkshire (GB)

( * ) Notice: Subject to any disclaimer, the term of this patent is extended or adjusted under 35 U.S.C. 154(b) by 0 days.

(21) Appl. No.: 09/735,524

(22) Filed: Dec. 14, 2000

(30) Foreign Application Priority Data

Jun. 14, 2000 (GB) ..... 0014602

(51) Int. Cl.[7] ..... B65D 6/08; B65D 1/24
(52) U.S. Cl. ..... 220/506; 220/666
(58) Field of Search ..... 220/506, 666, 220/667

(56) References Cited

U.S. PATENT DOCUMENTS 3,261,458 A * 7/1966 Nibeker ..... 220/506
3,326,458 A * 6/1967 Meryman et al. ..... 220/506
4,073,413 A 2/1978 Tabler et al.
4,573,632 A * 3/1986 Scheeren ..... 220/506
5,718,933 A 2/1998 Fultz
5,901,848 A 5/1999 Gorlich et al.

FOREIGN PATENT DOCUMENTS

FR 2 461 657 6/1981
WO 84/02892 8/1984

* cited by examiner

*Primary Examiner*—Joseph M. Moy
(74) *Attorney, Agent, or Firm*—Sughrue Mion, PLLC

(57) ABSTRACT

A sealable multicompartment container comprises a first inner compartment surrounded by a second compartment in the form of an annular trough, both compartments having upper edges for sealing with a closure lid and being joined by a folded wall member pliable to permit unfolding, thereby extending the container depth and merging the two compartments.

10 Claims, 3 Drawing Sheets

SEALABLE MULTICOMPARTMENT CONTAINER

The invention relates to sealable multicompartment containers and particularly to multicompartment food or drinks containers.

BACKGROUND OF THE INVENTION

Various products, including some food and drink products, are sold in packaged form with more than one component held in sealed isolated compartments prior to use and which are required to be mixed at the time of use. In the food and drink industry such products include various dairy products such as flavoured drinks or yoghurts. In other industries multiple chemical components may be held in sealed separate compartments up till use such as for example adhesive products where mixing is required prior to use.

It is an object of the present invention to provide an improved multicompartment container which may be formed with more than one compartment which may store constituents in isolation when the container is sealed but which may be adapted by change of shape after opening in order to provide a single container in which the constituents are mixed.

SUMMARY OF THE INVENTION

The invention provides a sealable multicompartment container having a first inner compartment surrounded by a second outer compartment each compartment having perimeter walls with upper edges of the walls of each compartment terminating in a closure plane with sealing regions on the upper edges for engaging with a closure lid to provide sealing of the container and isolation of each of the compartments, an outer perimeter wall of the first compartment and an inner perimeter wall of the outer compartment being formed by a folded wall member which is pliable to permit unfolding by pulling the inner compartment relative to the outer compartment, when the lid is removed, in a direction away from said upper edges so as to extend the container depth and cause the outer and inner compartments to merge into a single compartment. Preferably the second compartment forms an annular trough around the first compartment.

Preferably the first and second compartments have perimeter walls which are circular and concentric with each other at their upper edges.

Preferably the upper edges of the perimeter walls are formed with flat regions of sufficient area and rigidity to permit bonding in abutment with a sealable lid.

Preferably the inner and outer compartments are of similar depth when the container is not extended.

Preferably the inner perimeter wall of the outer compartment is formed of flexible corrugated sheet material.

The container may conveniently comprise a food or drinks container in which the inner compartment comprises a tub for containing food or drink and the outer compartment provides a receptacle for other food or drink which is held separately in the container when the container is sealed but which mixes or merges with the food or drink in the inner compartment when the lid is removed and the container extended to merge the compartments.

The container may be formed of plastics material.

The invention includes a container as aforesaid in combination with a lid in sealed engagement with the upper edges of the perimeter walls to close the container and isolate said first and second compartments.

The lid may comprise aluminum foil or a plastics film releasably bonded to the upper edges of the perimeter walls. The above container is conveniently made as a single unitary structure with the lid comprising a separate element.

DESCRIPTION OF THE PREFERRED EMBODIMENT

Figure 1:
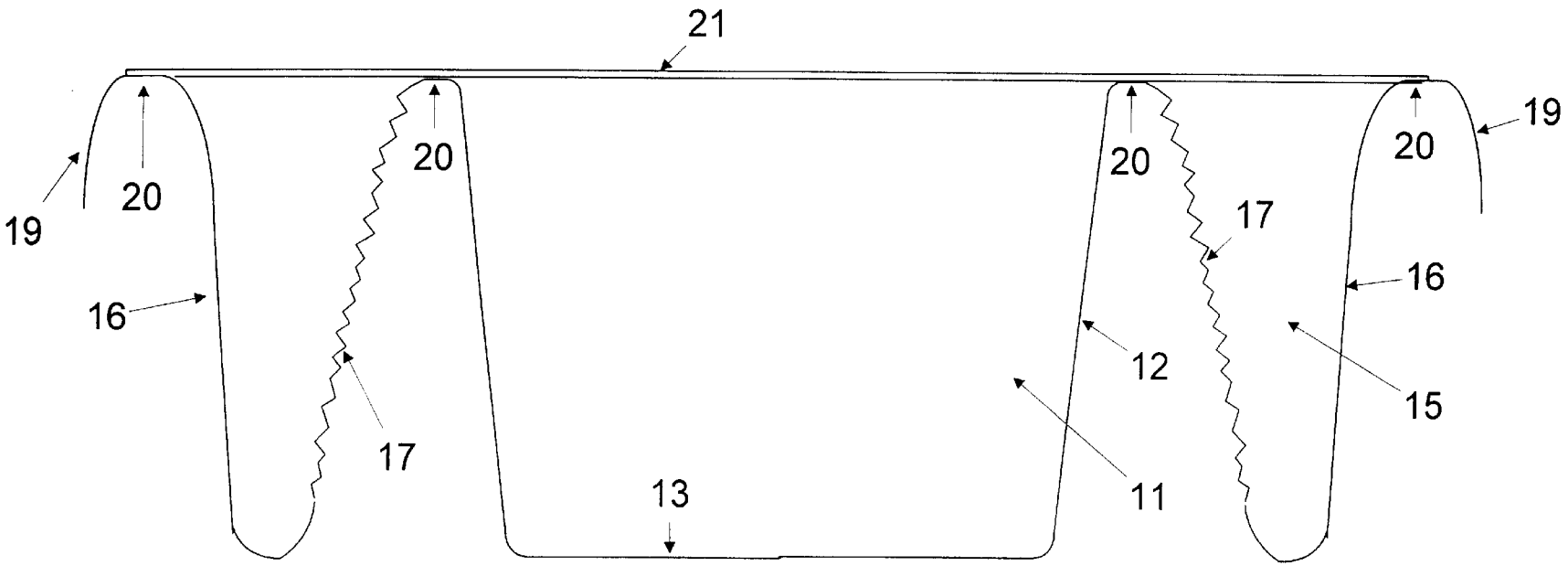
FIG. 1 is a side view in section of a multicompartment container in accordance with the present invention in a sealed condition.

The example shown in the drawings is particularly adapted for use in the food or drinks industry and may be conveniently used for products such as yoghurt or dessert products in which more than one constituent is held in isolation in the sealed condition but mixed on use.

Figure 2:
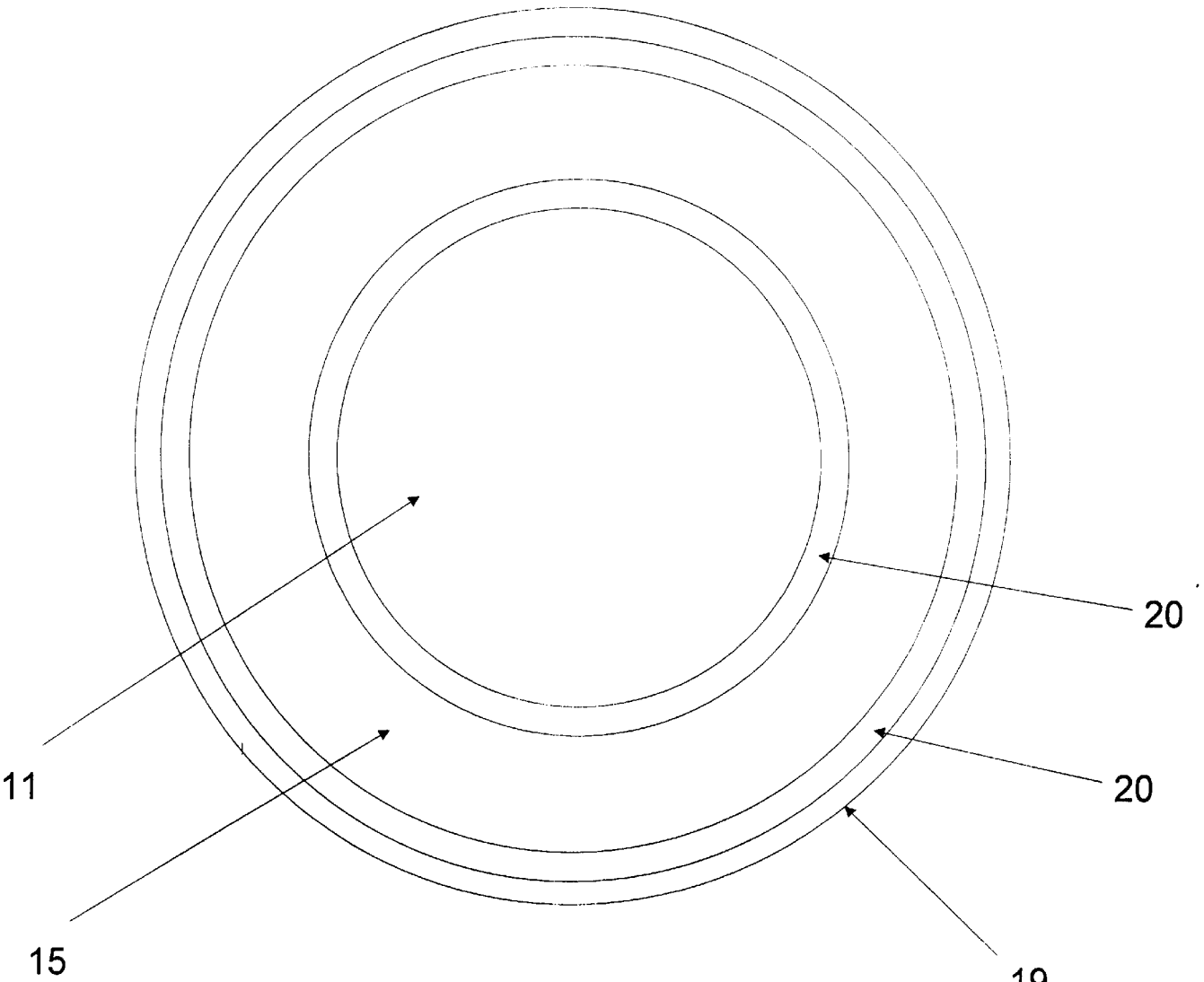
FIG. 2 is a plan view of the container with the lid removed.

The example shown in FIG. 1 comprises a central tub or pot 11 having an annular peripheral wall 12 formed integrally with a flat base 13. The wall 12 tapers inwardly towards the base 13 and is open mouthed at the top with a circular shape in plan as shown in FIG. 2. The tub 11 forms an inner compartment which is surrounded by an annular trough 15 extending entirely around the inner tub 11 and forming an outer compartment. The trough 15 has an outer peripheral wall 16 which in this example is a substantially vertical wall. It also has an inclined inner peripheral wall 17 formed as a flexible corrugated sheet which forms part of a folded structure with the outer peripheral wall 12 of the inner tub 11. The outer trough 15 is also open mouthed at its upper end and has the same depth as the inner tub 11. In this way the base 13 of the inner tub and the bottom of the trough 15 lie in the same plane and thereby rest in a stable manner when stacked or on a flat surface. The peripheral walls 16 and 17 of the outer trough 15 as well as the peripheral wall 12 of the inner tub 11 are formed as a single moulded sheet which has an overhanging lip 19 around the entire container.

The peripheral walls 12, 16 and 17 all have upper edges lying in a closure plane so as to provide sealing surfaces 20 on which a flat lid 21 sits in sealing engagement. Each of the sealing surfaces 20 is sufficiently wide, as shown in FIG. 2, and sufficiently rigid for the lid 21 to be pressed into sealing engagement with the top of the container and bonded thereto so as to seal in an isolated manner contents in the outer trough 15 and contents in the inner tub 11.

Figure 3:
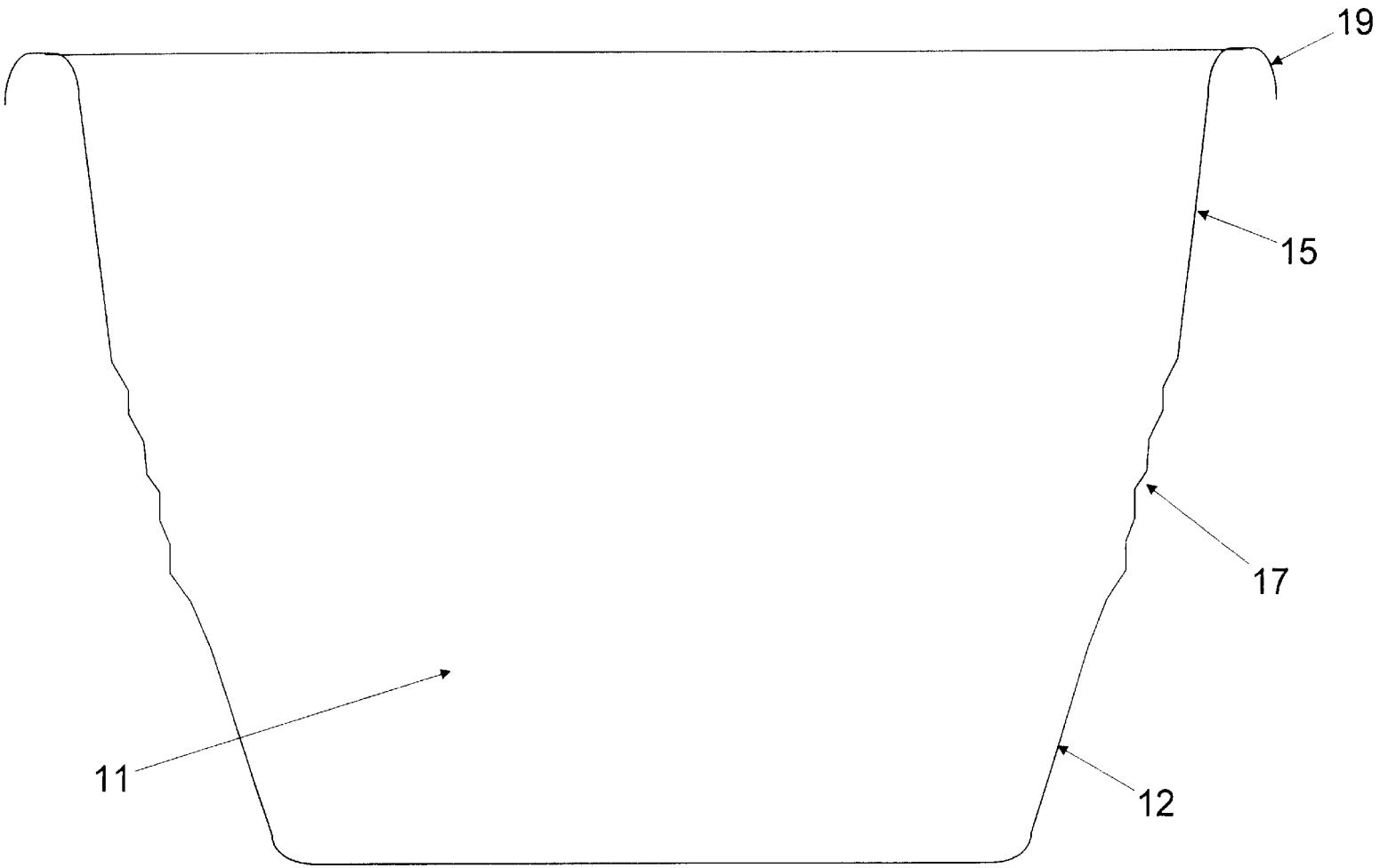
FIG. 3 is a side view in section with the lid removed and the container extended in depth in order to provide a single tub cavity.

In the sealed conditions shown in FIG. 1 the overall container has a depth indicated by that of the inner tub 11. When the lid 11 is peeled away from the top of the container thereby breaking the seal with the sealing regions 20, the container may be pulled to a different shape in order to increase its depth and merge the outer trough 15 with the inner tub 11. The walls 12 and 17 form part of a folded arrangement with the fold line normally lying at the sealing surface 20 at the upper part of the wall 12. When the tub 11 is pulled downwards relative to the outer walls 16 of the trough 15, the folded wall structure may be progressively unfolded by the fold line progressively moving down the wall marked 17. That is the pliable wall 17 which in this example is corrugated in order to provide increased flexibility and flow around the fold line at the junction between the outer trough 15 and the inner tub 11. This movement may be continued until the position is reached shown in FIG. 3 in which the walls 12, 15 and 17 have become fully extended and substantially aligned forming a tapered outer wall of a single pot combining the original inner compartment 11 and the outer trough 15.

It will be seen that the pot after extension in this way has a depth which is between two and three times the depth in the closed and sealed condition.

It will be appreciated that when used as a food container, the central tub 11 may be used for liquid or dry products. For example it could contain yoghurt or for example dry cereal. The outer trough 15 may be used for liquid sauces or for milk.

When used for food or drinks products, the container may conveniently be made of plastics material such as for example polypropylene. Alternatively waxed board or waxed paper may be used. The lids may be made of various materials such as for example aluminum or polypropylene foil or alternatively paper lids may be sealed against the container.

The material used for the container and the lid will be selected in accordance with the nature of the product to be held in the container.

The nature of the material and thickness used to form the walls of the container will be such that the walls are flexible enough to allow ease of movement between the sealed and extended positions while the external wall will be rigid enough to provide support for the entire structure when extended. The materials used may be adapted to withstand chilling or microwave treatment.

The invention is not limited to the details of the foregoing example. Although the particular example is shown where the two compartments are arranged concentrically one around the other, other designs may be used. The relative heights of the inner and outer compartments as well as their relative widths may be varied to suit the volume ratios required of the different constituents which are required in the container.

In the example shown in the drawings, the upper edges of the walls 12, 16 and 17 lie in the plane of the lid, referred to as a closure plane, which in that example is a flat horizontal plane. It will be understood that the reference to a closure plane is a reference to the plane of the lid which may in some examples have small deviations from flat, or horizontal.

The preferred example described in the drawings has a shape which allows the containers prior to filling and sealing to be stacked in a nested manner one extending inside another but other shapes may be used where necessary.

What is claimed is:

1. A sealable multicompartment container having a first inner compartment surrounded by a second outer compartment each compartment having perimeter walls with upper edges of the walls of each compartment terminating in a closure plane with sealing regions on the upper edges for engaging with a closure lid to provide sealing of the container and isolation of each of the compartments, an outer perimeter wall of the first compartment and an inner perimeter wall of the outer compartment being formed by a folded wall member which is pliable to permit unfolding by pulling the inner compartment relative to the outer compartment when the lid is removed, in a direction away from said upper edges so as to extend the container depth and cause the outer and inner compartments to merge into a single compartment, the inner perimeter wall of the outer compartment having increased flexibility relative to the outer perimeter wall of the inner compartment so that when the folded wall member is unfolded, a fold line between the outer perimeter wall of the inner compartment and the inner perimeter wall of the outer compartment, progressively moves down the inner perimeter wall of the outer compartment.

2. A container according to claim 1 in which the second compartment forms an annular trough around the first compartment.

3. A container according to claim 2 in which the first and second compartments have perimeter walls which are circular and concentric with each other at their upper edges.

4. A container according to claim 1 in which the upper edges of the perimeter walls are formed with flat regions of sufficient area and rigidity to permit bonding in abutment with a sealable lid.

5. A container according to claim 1 in which the inner and outer compartments are of similar depth when the container is not extended.

6. A container according to claim 1 in which the inner perimeter wall of the outer compartment is formed of flexible corrugated sheet material.

7. A container according to claim 1 comprising a food or drinks container in which the inner compartment comprises a tub for containing food or drink and the outer compartment provides a receptacle for other food or drink which is held separately in the container when the container is sealed but which mixes or merges with the food or drink in the inner compartment when the lid is removed and the container extended to merge the compartments.

8. A container according to claim 1 formed of plastics material.

9. A container according to claim 1 in combination with a lid in sealed engagement with the upper edges of the perimeter walls to close the container and isolate said first and second compartments.

10. A container with a lid according to claim 9 in which the lid comprises aluminum foil releasably bonded to the upper edges of the perimeter walls.

* * * * *